US009617986B2

(12) United States Patent
Inagaki et al.

(10) Patent No.: US 9,617,986 B2
(45) Date of Patent: Apr. 11, 2017

(54) HERMETIC COMPRESSOR

(71) Applicant: Panasonic Intellectual Property Management Co., Ltd., Osaka-shi, Osaka (JP)

(72) Inventors: Ko Inagaki, Shiga (JP); Noboru Iida, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 316 days.

(21) Appl. No.: 14/407,378

(22) PCT Filed: Jun. 11, 2013

(86) PCT No.: PCT/JP2013/003640
§ 371 (c)(1),
(2) Date: Dec. 11, 2014

(87) PCT Pub. No.: WO2013/187043
PCT Pub. Date: Dec. 19, 2013

(65) Prior Publication Data

US 2015/0159640 A1 Jun. 11, 2015

(30) Foreign Application Priority Data

Jun. 13, 2012 (JP) ..... 2012-133440

(51) Int. Cl.
*F04B 35/04* (2006.01)
*F04B 17/03* (2006.01)
(Continued)

(52) U.S. Cl.
CPC ..... *F04B 17/03* (2013.01); *F04B 35/04* (2013.01); *F04B 39/0246* (2013.01); *F04B 39/14* (2013.01)

(58) Field of Classification Search
CPC ..... F04B 39/023; F04B 35/04; F04B 17/03; F04B 2203/0203; F16C 19/10; H02K 23/44; H02K 7/125
(Continued)

(56) References Cited

U.S. PATENT DOCUMENTS

2005/0089416 A1 4/2005 Lee
2009/0116982 A1* 5/2009 Tsuboi ..... F04B 39/0094 417/410.1

FOREIGN PATENT DOCUMENTS

CN 101871443 10/2010
CN 101900100 12/2010
(Continued)

OTHER PUBLICATIONS

English Translation of Chinese Search Report dated Feb. 23, 2016 for the related Chinese Patent Application No. 201380030884.9, (2 pages).

*Primary Examiner* — Devon Kramer
*Assistant Examiner* — Kenneth J Hansen
(74) *Attorney, Agent, or Firm* — Hamre, Schumann, Mueller & Larson, P.C.

(57) ABSTRACT

A hermetic compressor includes: a main bearing (126) which supports a main shaft (120) of a shaft (119); and a thrust ball bearing at an upper end portion of the main bearing (126). A rotor (116) is fixed to the main shaft (120) via a flange. A rotor core (117) has a magnetic center displaced upward relative to the magnetic center of a stator core (115) so that a downward magnetic attractive force is applied between the rotor (116) and the stator (114). Accordingly, a contact load between steel balls and upper and lower races in the thrust ball bearing is appropriately maintained.

5 Claims, 5 Drawing Sheets

(51) Int. Cl.
*F04B 39/02* (2006.01)
*F04B 39/14* (2006.01)

(58) Field of Classification Search
USPC ..... 417/365
See application file for complete search history.

(56) References Cited

FOREIGN PATENT DOCUMENTS

| | | | |
|---|---|---|---|
| JP | 56-15475 | U | 2/1981 |
| JP | 2005-127305 | | 5/2005 |
| JP | 2009-019571 | | 1/2009 |
| JP | 2010-101278 | | 5/2010 |
| JP | 2012-031769 | | 2/2012 |
| JP | 2012-082783 | | 4/2012 |
| KR | 10-0593625 | B | 6/2006 |

* cited by examiner

HERMETIC COMPRESSOR

TECHNICAL FIELD

The present invention relates to hermetic compressors used in the refrigeration cycle mainly of electric refrigerator-freezers.

BACKGROUND ART

In recent years, hermetic compressors used in electric refrigerator-freezers desirably have increased efficiency for less power consumption, reduced noise, and increased reliability.

There is a conventional hermetic compressor of this type which includes a ball bearing as a thrust bearing to increase efficiency (see, for example, Patent Literature 1).

The conventional hermetic compressor will be described as follows with reference to the drawings.

FIG. 4 is a longitudinal sectional view of the conventional hermetic compressor. FIG. 5 is an exploded perspective view of an essential part of the conventional hermetic compressor.

In FIG. 4 and FIG. 5, lubricating oil 4 is stored in the bottom of hermetic container 2. Hermetic container 2 includes compressor body 6 resiliently supported by suspension springs (not illustrated).

Compressor body 6 includes motor element 10 and compression element 12 disposed above motor element 10. Motor element 10 includes stator 14 and rotor 16.

Compressor element 12 includes shaft 19 which includes main shaft 20, arm 21 disposed at the upper end of main shaft 20, and eccentric shaft 22 extending from the top surface of arm 21. Main shaft 20, to which rotor 16 is fixed, is rotatably supported by main bearing 26 of cylinder block 24. A compression load applied to eccentric shaft 22 is supported by main shaft 20 and main bearing 26 which are disposed below eccentric shaft 22 so as to form a cantilever bearing.

Shaft 19 has lubrication mechanism 29 including inclined hole 27 inside main shaft 20, lead groove 28 on the surface of main shaft 20, and the like.

Piston 30 is reciprocatable in cylinder 34 having a substantially cylindrical inner surface in cylinder block 24. Connection portion 36 has ends each provided with a hole. Piston pin 38 of piston 30 and eccentric shaft 22 are fitted into the holes so as to connect eccentric shaft 22 and piston 30.

Cylinder 34 and piston 30 form compression space 42 together with valve plate 40 disposed on the open end face of cylinder 34. Valve plate 40 is covered with fixed cylinder head 44.

Cylinder head 44 is equipped with intake muffler 46 which is molded with a resin such as PBT (polybutylene terephthalate) and which has a sound absorbing space inside.

The following is a description of thrust ball bearing 50.

Main bearing 26 includes, on the upper end surface, thrust face 52 which is a planar portion perpendicular to the central axis.

Thrust ball bearing 50, which includes upper race 54, steel balls 56 held by holder 58, and lower race 60, is disposed above thrust face 52.

Upper race 54 and lower race 60 are annular metal plates each having parallel top and bottom sides. Holder 58 is annular in shape and has a plurality of holes in the circumferential direction in which steel balls 56 are held rotatably.

On thrust face 52, lower race 60, steel balls 56 held by holder 58, and upper race 54 are stacked in contact with each other in this order. Arm 21 of shaft 19 is placed on the top surface of upper race 54.

The hermetic compressor having the above-described structure operates as follows.

When electric power is supplied to motor element 10, stator 14 generates a rotating magnetic field, which allows rotor 16 to rotate with main shaft 20. The rotation of main shaft 20 causes eccentric motion of eccentric shaft 22, which is transmitted to piston 30 via connection portion 36, allowing piston 30 to reciprocate in cylinder 34.

A refrigerant returned from a refrigeration cycle (not illustrated) outside hermetic container 2 is introduced into compression space 42 via intake muffler 46, compressed by piston 30 in compression space 42, and sent from hermetic container 2 to the refrigeration cycle.

The bottom of shaft 19 is soaked in lubricating oil 4, so that the rotation of shaft 19 allows lubricating oil 4 to be supplied by lubrication mechanism 29 to each unit of compression element 12 so as to lubricate the sliding part.

Thrust ball bearing 50 is a rolling bearing in which steel balls 56 are made to roll while being in point contact with upper race 54 and lower race 60. Thrust ball bearing 50 is rotatable while supporting a vertical axial load such as the weights of shaft 19 and rotor 16. Rolling bearings have less friction than generally-used thrust ball bearings which are slide bearings, and thus, a force to be applied can be reduced, leading to increased efficiency.

In the above conventional structure, however, use of a thrust ball bearing in an inverter compressor involving high-speed rotation at a frequency greater than a power-supply frequency results in an unstable contact between the steel balls and the upper and lower races in the thrust ball bearing at high-speed rotation at a frequency greater than the power-supply frequency. The unstable contact is caused because the upper and lower races generally have minute unevenness on the surfaces. Such unstable contact leads to increased noise and vibration.

CITATION LIST

Patent Literature

PTL 1: Japanese Unexamined Patent Application Publication No. 2005-127305

SUMMARY OF THE INVENTION

A hermetic compressor according to the present invention includes a thrust ball bearing including: a plurality of steel balls; an upper race above the steel balls; and a lower race below the steel balls. A rotor is fixed to a main shaft via a flange. Moreover, in the present invention, the magnetic center of a rotor core is displaced upward relative to the magnetic center of the stator core. A downward load is applied to the rotor by the magnetic attractive force applied between the rotor core and the stator core. This appropriately maintains a contact load applied between the steel balls and the upper and lower races in the thrust ball bearing, thereby preventing noise and vibration.

DESCRIPTION OF EMBODIMENT

An embodiment of the present invention will be described below with reference to the drawings. Note that the present invention should not be limited to the embodiment.

Figure 1:
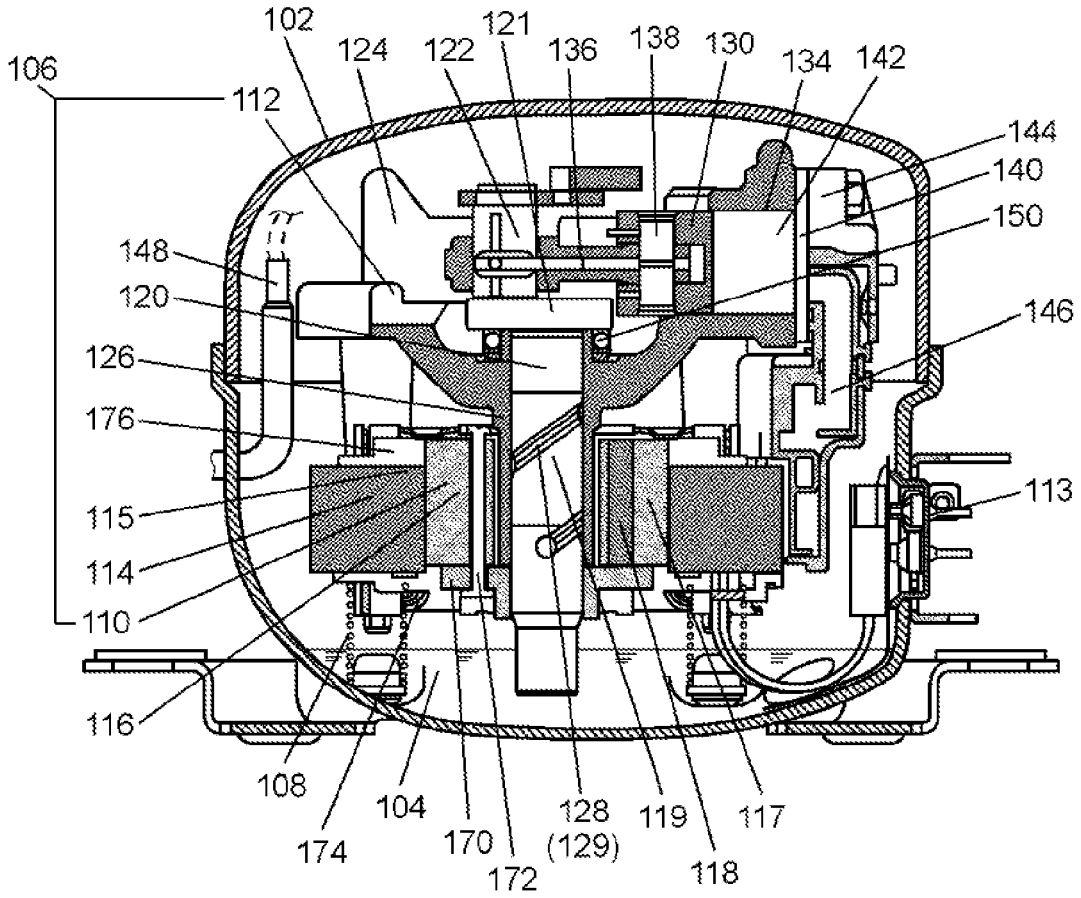
FIG. 1 is a longitudinal sectional view of a hermetic compressor according to one embodiment of the present invention.
Figure 2:
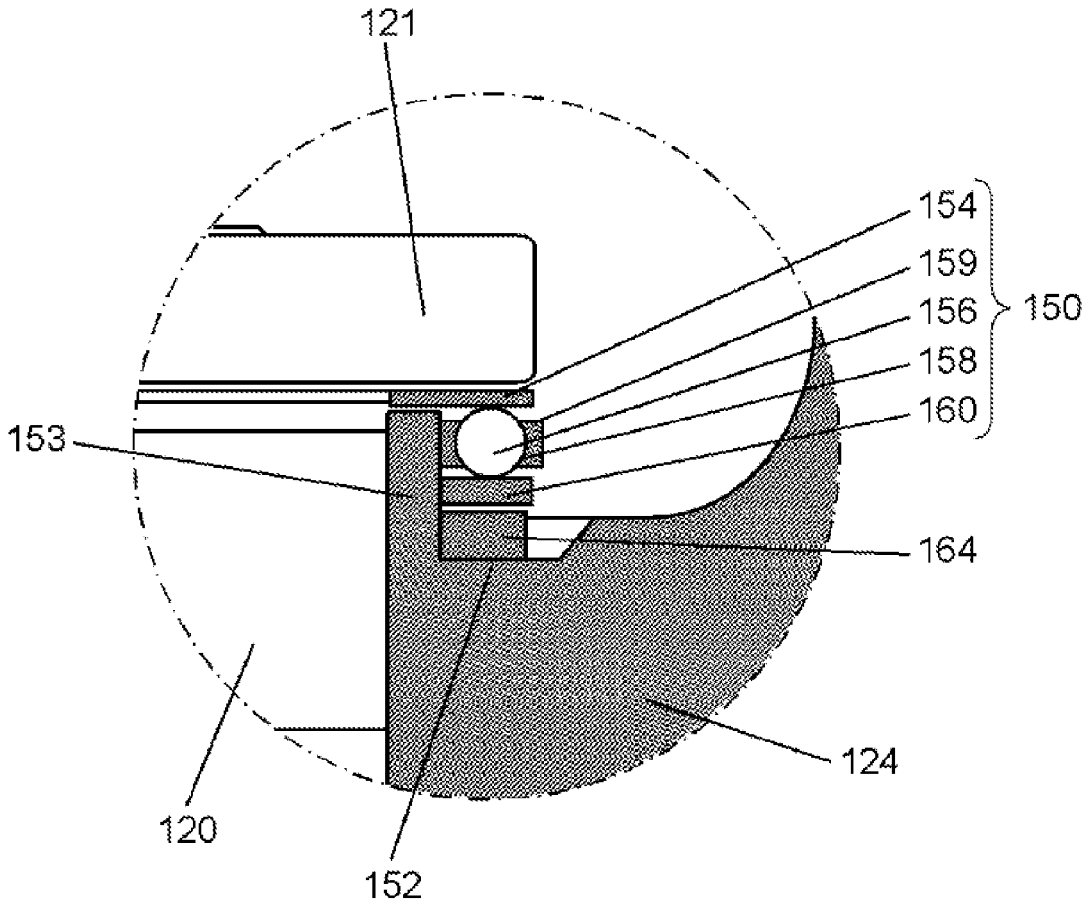
FIG. 2 is an enlarged view of a thrust ball bearing of the hermetic compressor according to the embodiment of the present invention.
Figure 3:
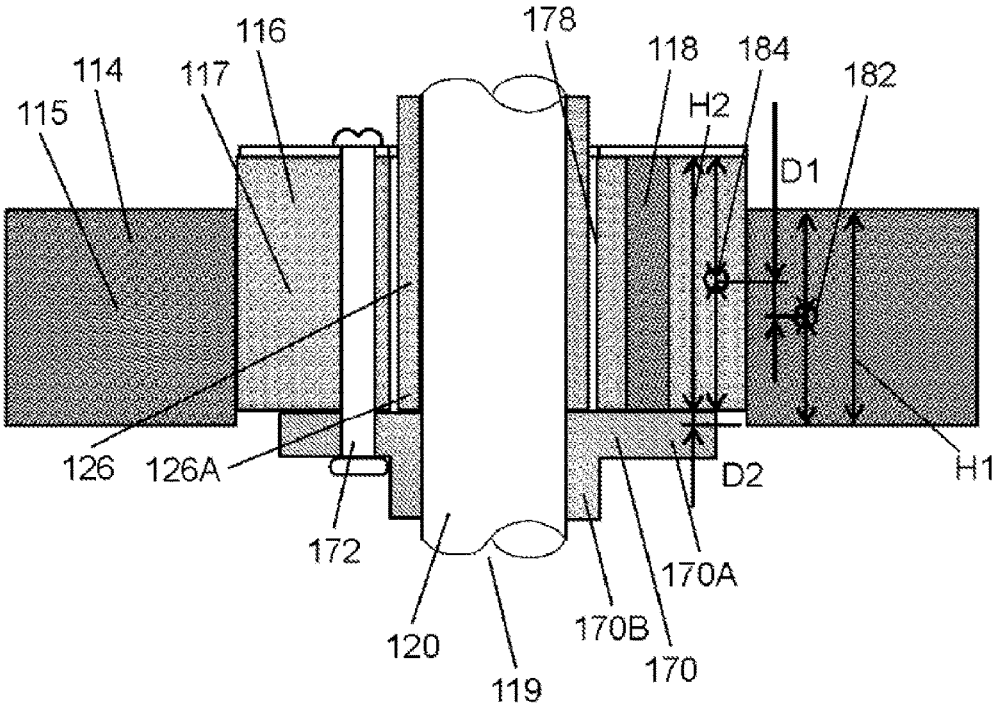
FIG. 3 is an enlarged view of an essential part near a motor element of the hermetic compressor according to the embodiment of the present invention.
Figure 4:
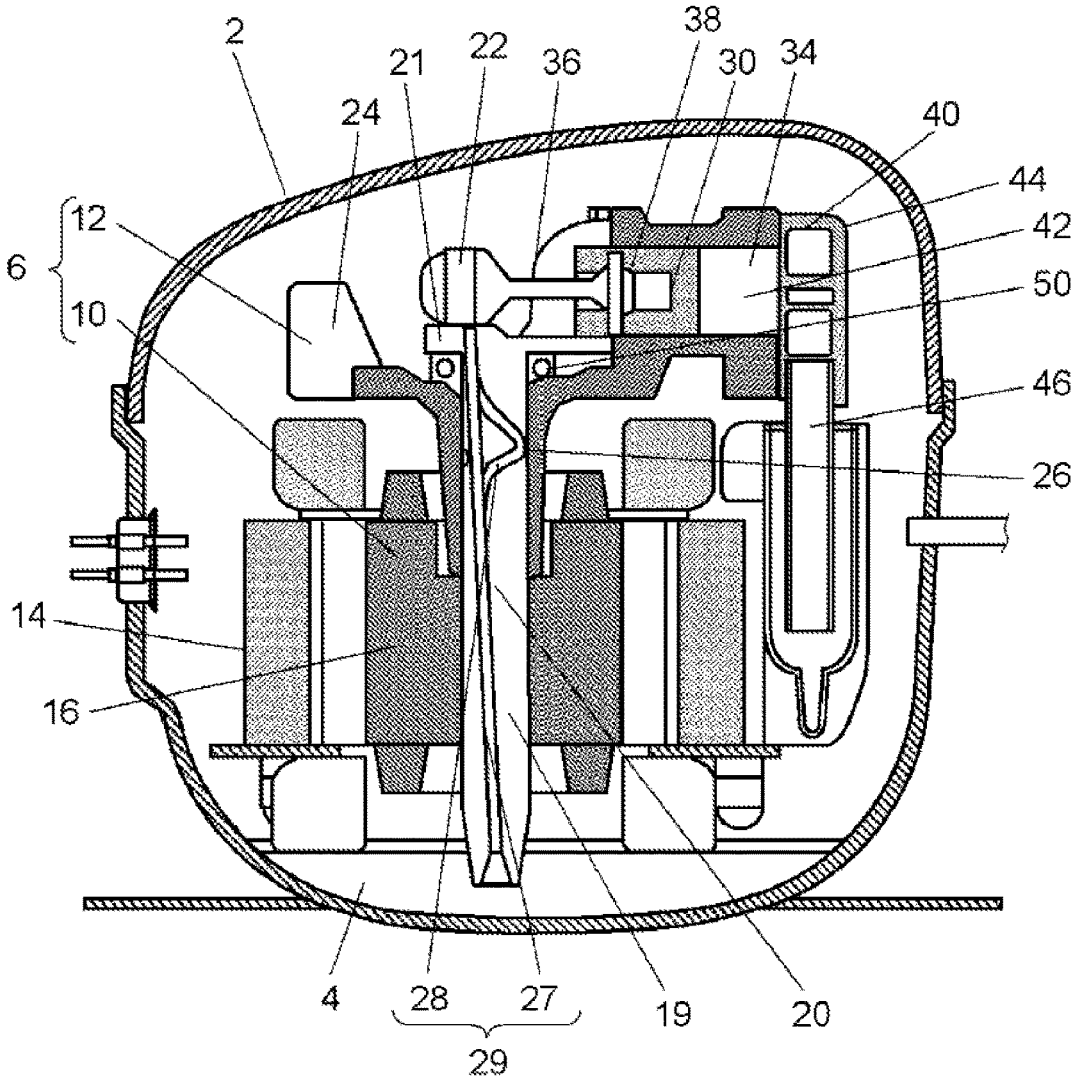
FIG. 4 is a longitudinal sectional view of a conventional hermetic compressor.
Figure 5:
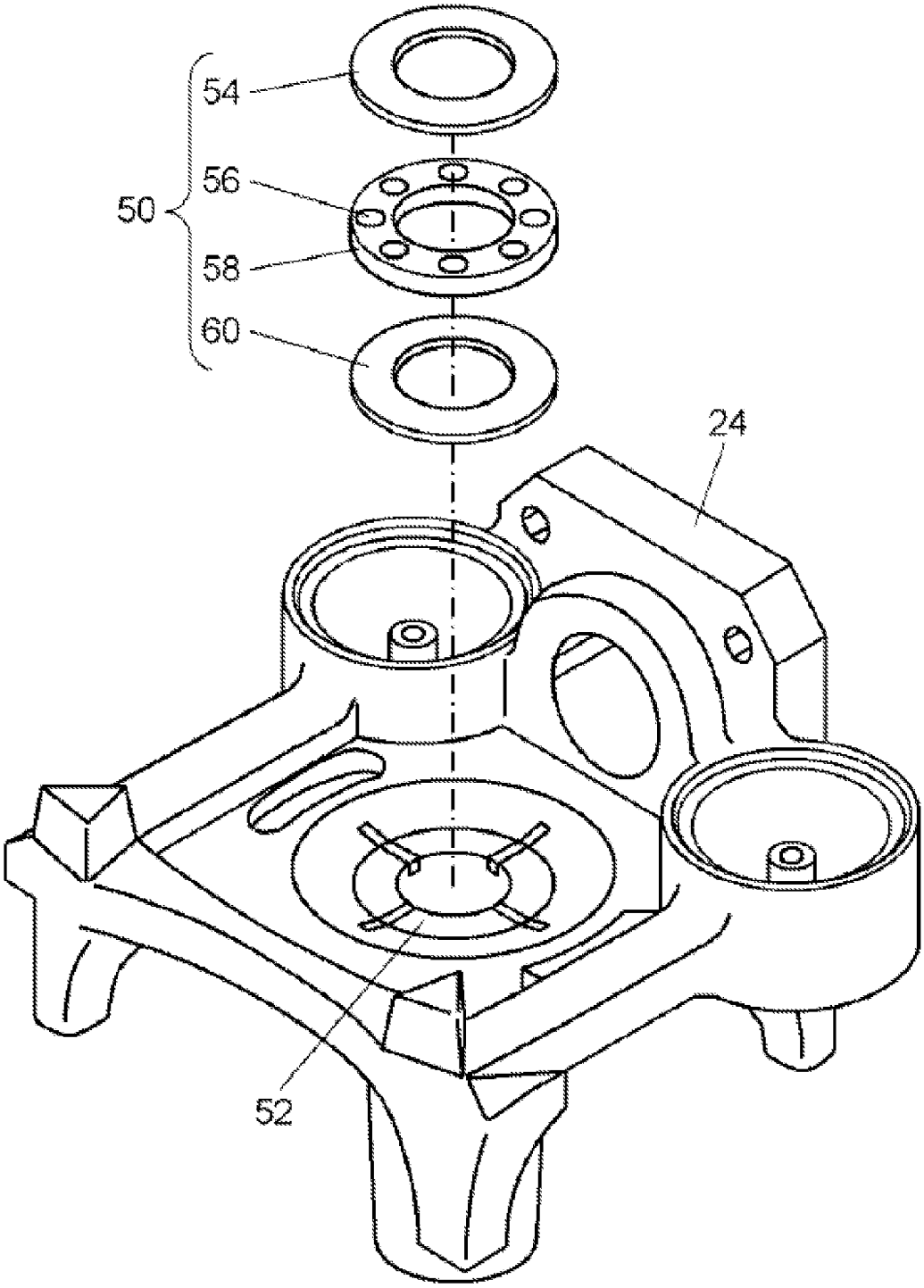
FIG. 5 is an exploded perspective view of an essential part of the conventional hermetic compressor.

FIG. 1 is a longitudinal sectional view of a hermetic compressor according to one embodiment of the present invention. FIG. 2 is an enlarged view of a thrust ball bearing of the hermetic compressor according to the embodiment of the present invention. FIG. 3 is an enlarged view of an essential part near a motor element of the hermetic compressor according to the embodiment of the present invention.

In the drawings, hermetic container 102 stores lubricating oil 104 at the bottom. Compressor body 106 including motor element 110 and compression element 112 driven by motor element 110 is resiliently supported by suspension springs 108 in hermetic container 102. Hermetic container 102 is filled with R600A (isobutane) which is a refrigerant having a low global warming potential.

Hermetic container 102 is provided with power supply terminal 113 through which electric power is supplied to motor element 110.

First, compression element 112 will be described.

Compression element 112 is disposed above motor element 110.

Compression element 112 includes shaft 119. Shaft 119 includes: main shaft 120; arm 121 at the upper end portion of main shaft 120; and eccentric shaft 122 extending from the top surface of arm 121, having a central axis different from that of main shaft 120, and parallel to main shaft 120.

Cylinder block 124 includes main bearing 126 having a cylindrical inner surface. Main shaft 120 of shaft 119 is rotatably supported in and by main bearing 126. Compression element 112 has a cantilever bearing where a load applied to eccentric shaft 122 is supported by main shaft 120 and main bearing 126 which are disposed below eccentric shaft 122.

Shaft 119 has lubrication mechanism 129 including an inclined hole (not illustrated) inside main shaft 120, spiral lead groove 128 on the surface of main shaft 120, and the like.

Cylinder block 124 includes cylinder 134 which is a cylindrical hole. Piston 130 is reciprocatable in cylinder 134.

Connection portion 136 has a hole at each end. Piston pin 138 of piston 130 and eccentric shaft 122 are fitted into the holes so as to connect eccentric shaft 122 and piston 130.

Cylinder 134 has an end face provided with valve plate 140 which forms compression space 142 together with cylinder 134 and piston 130. Valve plate 140 is covered with fixed cylinder head 144. Cylinder head 144 is equipped with intake muffler 146 which is molded with a resin such as PBT (polybutylene terephthalate) in such a manner as to have a sound absorbing space inside.

Main bearing 126 includes thrust face 152 and bearing extension portion 153. Thrust face 152 is a planar portion perpendicular to the central axis. Bearing extension portion 153 extends upward beyond thrust face 152 and has an inner surface facing main shaft 120.

Upper race 154 is disposed above bearing extension portion 153. Steel balls 156 held in holder 158 and lower race 160 are disposed on the outer-diameter side of bearing extension portion 153 and below upper race 154. Upper race 154, steel balls 156, and lower race 160 form thrust ball bearing 150.

Elastic member 164 which is elastically deformable in the vertical direction is disposed between the bottom of lower race 160 and thrust face 152.

Upper race 154 and lower race 160 of thrust ball bearing 150 are annular metal plates, and preferably comprise heat-treated spring steel or the like. These metal plates have parallel top and bottom sides each having a finished smooth surface.

Holder 158 is annular in shape and comprises a resin such as polyamide, and has a plurality of holes 159 in which steel balls 156 are held rotatably.

Next, motor element 110 will be described.

Motor element 110 is a DC brushless motor with salient-pole concentrated winding, and includes stator 114 and rotor 116. Stator 114 is formed of winding 174 which is directly wound around, via insulating material, a plurality of magnetic pole teeth (not illustrated) of stator core 115 formed of stacked magnetic steel sheets. Rotor 116 is disposed on the inner-diameter side of stator 114. Rotor core 117 formed of stacked magnetic steel sheets includes permanent magnet 118.

The DC brushless motor can obtain a strong magnetic force by permanent magnet 118. Accordingly, the height of stator core 115 and rotor core 117 of the DC brushless motor is lower than those in an induction motor including no permanent magnet. Rotor 116 of the DC brushless motor is lighter than that of the induction motor.

The winding of stator 114 is connected, passing through power supply terminal 113, to a control circuit (not illustrated) outside the hermetic compressor via a conductive wire. Motor element 110 is driven in a wide operating range from a low speed of 20 r/s approximately to a high speed of 80 r/s approximately.

Flange 170 comprising a non-magnetic material such as SUS304 or brass is disposed below rotor core 117 of rotor 116. Rotor core 117 and flange 170 are fixed to each other by staking pin 172. As FIG. 3 illustrates details, the outer diameter of upper flange portion 170A through which staking pin 172 penetrates is smaller than that of rotor core 117. Upper flange portion 170A has an approximate disk shape and has a center portion provided with a hole which is engaged with main shaft 120. The lower portion of flange 170 has extension portion 170B having an outer diameter smaller than that of upper flange portion 170A. In a similar manner to upper flange portion 170A, the lower portion of flange 170 has a center portion provided with a hole which is engaged with main shaft 120.

Rotor 116 is fixed to main shaft 120 via flange 170 by heat staking or the like. Wrap 178 is a cylindrical hole provided at the inner diameter side of rotor core 117. Main bearing 126 extends into wrap 178, so that bottom 126A of main bearing 126 closely faces the top surface of upper flange portion 170A of flange 170.

Stator core 115 has a height of H1, and rotor core 117 has a height of H2 that is greater than H1. Stator 114 has magnetic center 182 at a height of H1/2 from the bottom of stator 114. Rotor 116 has magnetic center 184 at a height of H2/2 from the bottom of rotor 116. Rotor core 117 has magnetic center 184 displaced upward by distance D1 relative to magnetic center 182 of stator core 115.

Rotor core 117 has a bottom at a position higher by D2 than that of stator core 115.

The hermetic compressor having the above-described structure operates as follows.

When electric power is supplied to motor element 110 through power supply terminal 113, stator 114 generates a magnetic field, which allows rotor 116 to rotate with shaft 119. The rotation of main shaft 120 makes eccentric shaft 122 perform eccentric rotation, which is converted by connection portion 136 so as to allow piston 130 to reciprocate in cylinder 134. Compression space 142 volumetrically changes so as to perform a compression operation in which the refrigerant is suctioned from hermetic container 102 to compression space 142 and then compressed.

In the intake stroke in the compression operation, the refrigerant in hermetic container 102 is intermittently suctioned into compression space 142 through intake muffler 146, and compressed in compression space 142. After compressed, the high-temperature, high-pressure refrigerant is sent from hermetic container 102 to the refrigeration cycle (not illustrated) through discharge pipe 148 or the like.

The bottom of shaft 119 is soaked in lubricating oil 104, so that the rotation of shaft 119 allows lubricating oil 104 to be supplied to each sliding part such as main shaft 120 by lubrication mechanism 129.

Since magnetic center 184 of rotor 116 is displaced upward by D1 relative to magnetic center 182 of stator 114, a force in the direction of gravity is applied to rotor 116 by the magnetic attractive force applied between stator 114 and rotor 116.

Moreover, since the bottom of rotor core 117 is displaced upward by D2 relative to the bottom of stator core 115, a stronger downward magnetic attractive force is applied to rotor 116.

As a result, in addition to the loads of the weights of rotor 116 and shaft 119, a downward load due to the magnetic attractive force is applied to thrust ball bearing 150. This allows an appropriate load to be constantly applied to the contact points between steel balls 156 and upper race 154 and lower race 160.

Accordingly, stable contact states are achievable even when rotor 116 is light and operates at high speed, thereby preventing thrust ball bearing 150 from having noise and vibration. Moreover, slipping of steel balls 156 and upper race 154 and lower race 160 is prevented and a stable rolling state can be maintained. This prevents peeling, abrasion and the like, leading to increased reliability.

Upper flange portion 170A has an outer diameter smaller than that of rotor core 117. The gap between the outer circumference of upper flange portion 170A and stator core 115 is large. Hence, almost no magnetic attractive force is applied between upper flange portion 170A and stator core 115. As a result, the magnetic attractive force applied between stator 114 and rotor 116 is not reduced and is stable. Accordingly, the contact load of thrust ball bearing 150 is prevented from decreasing, leading to reliable prevention of noise and vibration. Additionally, steel balls 156 and upper race 154 and lower race 160 are prevented from slipping, leading to increased reliability.

Since flange 170 comprises a non-magnetic material, no magnetic attractive force is caused between upper flange portion 170A and stator core 115. As a result, decrease in the contact load of thrust ball bearing 150 can be more reliably prevented. Moreover, overcurrent can be prevented from occurring in flange 170 even under influence of the magnetic field of rotor core 117, and thus, it is possible to prevent efficiency of motor element 110 from decreasing and efficiency of the hermetic compressor from decreasing.

In a general cantilever bearing, when a load is applied from connection portion 136 to eccentric shaft 122 of shaft 119, if the bearing is short, a load caused by moment at the top and bottom portions of main shaft 126 increases. This increases abrasion, which hinders a hermetic compressor to have high efficiency and high reliability.

According to the present invention, large portions of main shaft 126 overlap the inside of rotor core 117. This leads to reduced height of the compressor while maintaining sufficient length of main shaft 126.

Moreover, the outer diameter of extension portion 170B is significantly smaller than that of rotor core 117. Hence, even if the refrigerant melts into lubricating oil 104, the oil surface level is increased, and extension portion 170B at the lower portion of flange 170 contacts lubricating oil 104, it is possible to prevent agitation of lubricating oil 104 from causing noise and causing foaming of the refrigerant in lubricating oil 104.

Accordingly, compared to the case where rotor core 117 is directly fixed to main shaft 120, use of flange 170 allows rotor 116 to be positioned closer to the oil surface, allowing further reduction in height of the compressor.

This facilitates user-friendliness of hermetic compressors, such as increased volume inside refrigerators without change in the overall size of the refrigerators.

In the present embodiment, flange 170 comprises a non-magnetic material, but flange 170 may comprise a ferrous material, such as a sintered material, which is a similar ferrous material of shaft 119. As a result, flange 170 can have a same linear expansion coefficient as shaft 119, which facilitates use of heat staking and the like to fix rotor 116 to shaft 119.

A hermetic compressor according to the present invention includes a hermetic container which stores lubricating oil and includes a motor element and a compression element disposed above the motor element. The motor element includes: a stator including a stator core and a winding; and a rotor including a rotor core, a permanent magnet, and a flange which is disposed below the rotor core. The compression element includes: a shaft having a main shaft and an eccentric shaft; a cylinder block having a cylinder; a piston reciprocatable in the cylinder; a connection portion which connects the piston and the eccentric shaft; a main bearing which is disposed in the cylinder block and supports the main shaft of the shaft; and a thrust ball bearing disposed at an upper end portion of the main bearing and including a plurality of steel balls, an upper race above the plurality of steel balls, and a lower race below the plurality of steel balls. The rotor is fixed to the main shaft via the flange, and the rotor core has a magnetic center displaced upward relative to a magnetic center of the stator core.

With such a structure, an appropriate contact load applied between the steel balls and the upper and lower races can be maintained, which stabilizes the contact state between the steel balls and the upper and lower races. This prevents noise and vibration, and prevents slipping of the steel balls and the upper and lower races. As a result, increased reliability can be obtained.

Moreover, in the present invention, the rotor core has a bottom at a position higher than a position of a bottom of the stator core. With such a structure, a magnetic attractive force between the rotor core and the stator core can be obtained more reliably, preventing the contact load of the thrust ball bearing from decreasing, and more reliably preventing noise and vibration. Moreover, reliability can be increased by preventing slipping of the steel balls and the races.

Moreover, in the present invention, the flange has an outer diameter smaller than an outer diameter of the rotor core. With such a structure, the gap between the flange and the stator core is increased, and less magnetic attractive force is applied between the flange and the stator core, thereby preventing the contact load of the thrust ball bearing from decreasing. Additionally, noise and vibration are prevented more reliably, and higher reliability is achievable by preventing slipping of the steel balls and the upper and lower races.

Furthermore, in the present invention, the flange comprises a non-magnetic material. Such a structure prevents overcurrent from being caused in the flange due to the influence of the magnetic flux of the rotor core. Furthermore, it is possible to prevent decrease in efficiency of the motor element, thereby preventing the efficiency of the hermetic compressor from decreasing.

Furthermore, in the present invention, the main bearing extends into an inner diameter side of the rotor core and has a bottom closely facing a top surface of an upper portion of the flange. With such a structure, sufficient length of the main bearing reduces increase in contact pressure generated between the main shaft and the main bearing during operation. This leads to higher reliability. Moreover, the height of the hermetic compressor is reduced by disposing the main bearing so as to overlap the rotor core. This facilitates user-friendliness, such as increased volume inside refrigerators without change in the overall size of the refrigerators.

INDUSTRIAL APPLICABILITY

As described, the hermetic compressor according to the present invention can be widely applied not only to household electric refrigerator-freezers, but also to air conditioners, vending machines, and other refrigerating devices.

REFERENCE MARKS IN THE DRAWINGS

2, 102 hermetic container
4, 104 lubricating oil
6, 106 compressor body
10, 110 motor element
12, 112 compression element
14, 114 stator
16, 116 rotor
19, 119 shaft
20, 120 main shaft
21, 121 arm
22, 122 eccentric shaft
24, 124 cylinder block
26, 126 main bearing
27 inclined hole
28, 128 lead groove
29, 129 lubrication mechanism
30, 130 piston
34, 134 cylinder
36, 136 connection portion
38, 138 piston pin
40, 140 valve plate
42, 142 compression space
44, 144 cylinder head
46, 146 intake muffler
50, 150 thrust ball bearing
52, 152 thrust face
54, 154 upper race
56, 156 steel ball
58, 158 holder
60, 160 lower race
115 stator core
117 rotor core
118 permanent magnet
126A bottom
170 flange
170A upper flange portion
170B extension portion
174 winding
178 wrap
182, 184 magnetic center

The invention claimed is:

1. A hermetic compressor comprising:

a hermetic container for storing lubricating oil, the hermetic container including a motor element and a compression element disposed above the motor element, wherein the motor element includes a stator and a rotor, the stator including a stator core and a winding, the rotor including a rotor core, a permanent magnet, and a flange which is disposed below the rotor core, wherein the compression element includes:

a shaft having a main shaft and an eccentric shaft;

a cylinder block having a cylinder;

a piston reciprocatable in the cylinder;

a connection portion which connects the piston and the eccentric shaft;

a main bearing disposed in the cylinder block, the main bearing supporting the main shaft of the shaft; and a thrust ball bearing disposed at an upper end portion of the main bearing, the thrust ball bearing including a plurality of steel balls, an upper race above the plurality of steel balls, and a lower race below the plurality of steel balls, wherein the rotor is fixed to the main shaft via the flange, and wherein the rotor core has a magnetic center displaced upward relative to a magnetic center of the stator core.

2. The hermetic compressor according to claim 1, wherein the rotor core has a bottom at a position higher than a position of a bottom of the stator core.

3. The hermetic compressor according to claim 1, wherein the flange has an outer diameter smaller than an outer diameter of the rotor core.

4. The hermetic compressor according to claim 1, wherein the flange comprises a non-magnetic material.

5. The hermetic compressor according to claim 1, wherein the main bearing extends into an inner diameter side of the rotor core and has a bottom closely facing a top surface of an upper portion of the flange.

* * * * *